United States Patent [19]

Wagner

[11] 4,308,768

[45] Jan. 5, 1982

[54] RATCHET LEVER

[75] Inventor: Rudolf Wagner, Stuttgart, Fed. Rep. of Germany

[73] Assignee: Rems-Werk Christian Föll und Söhne GmbH & Co., Waiblingen, Fed. Rep. of Germany

[21] Appl. No.: 148,536

[22] Filed: May 9, 1980

[30] Foreign Application Priority Data

May 10, 1979 [DE] Fed. Rep. of Germany ..... 2918825

[51] Int. Cl.[3] ..... B25B 13/46

[52] U.S. Cl. ..... 81/60

[58] Field of Search ..... 81/60, 63.2, 63.1, 180 B, 81/185

[56] References Cited

U.S. PATENT DOCUMENTS

| | | | |
|---|---|---|---|
| 1,171,063 | 2/1916 | Nigborowicz | 81/185 |
| 1,352,764 | 9/1920 | Severen | 81/63.2 |
| 2,004,639 | 6/1935 | Thewes | 81/63.2 |

*Primary Examiner*—James L. Jones, Jr.
*Attorney, Agent, or Firm*—Becker & Becker, Inc.

[57] ABSTRACT

A ratchet lever with a ratchet head arranged on an actuating arm which has a head ring for receiving an interchangeable locking ring. The locking ring has an intermediate piece with at least one four-sided hole for plug or insert connection with a radiator nipple key.

9 Claims, 3 Drawing Figures

RATCHET LEVER

The present invention relates to a ratchet lever with a ratchet head arranged on an actuating arm and having a head ring for receiving an interchangeable locking ring.

To assemble and disassemble heating body radiators, heating installers use a special key, which has an outer four-sided portion for receiving a lever arm. For this purpose, conventional lever arms are used which are installed upon the outer four-sided portion and are extended or lengthened, for large torques, by the insertion of a pipe or the like. Using this means, the handling thereof is complex, and the stock and die in many cases are not sufficient for the high force requirements and consequently are bent or deformed. Additionally, it is disadvantageous that the stock and die must be especially acquired by the heating installer and must be kept ready. This is especially a burden since the heating installer also has a ratchet lever for carrying out the thread-cutting work on heating pipes; this ratchet lever is provided and embodied exclusively for receiving thread-cutting heads.

Accordingly, the object of the present invention is to improve a ratchet lever of the aforementioned type in such a way that a multiple-sided insertion or installation is possible, and a more economical utilization, as well as an easier handling, is achieved during the heating body radiator assembly.

This object, and other objects and advantages of the present invention, will appear more clearly from the following specification in connection with the accompanying drawings, in which.

Figure 1:
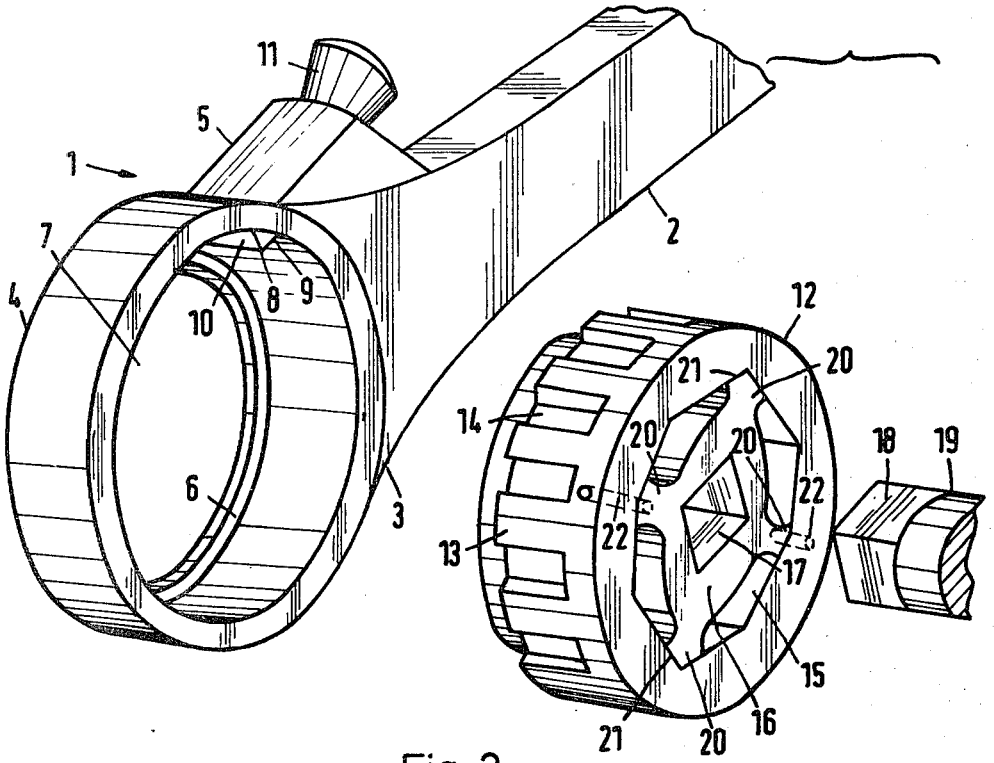
FIG. 1 is a partial exploded view of a ratchet lever including an interchangeable locking ring rigidly integrated with an intermediate piece.

The ratchet lever of the present invention is characterized primarily in that the locking ring is equipped with an intermediate piece having at least one four-sided hole for insertion connection with, for instance, a radiator nipple key. In this way, there is attained the advantage that with the same ratchet lever additionally a radiator nipple key can be used for the assembly and disassembly of heating body radiators in that a coupling connection is achieved by means of the intermediate piece arranged in the locking ring. The four-sided extension of the radiator nipple key is inserted in a socket or insertion-receiving means embodied as a four-sided hole in the intermediate piece, so that acquisition of an additional stock and die or special ratchet lever having a socket or insertion-receiving means embodied exclusively for the radiator nipple key can be eliminated, with a savings resulting with respect to the acquisition and storage costs.

A further advantage consists therein that the actuating arm of the ratchet lever is embodied long and stable due to the, in part considerable force required for cutting a pipe thread, so that also during assembly of heating body radiators, an easy turning of the radiator nipple key with a simple handling without any lever arm extension pipe results, and deformations are avoided due to the great stability of the actuating arm.

According to further features of the present invention, the intermediate piece may have support webs or crosspieces which are arranged in a multiple-sided hole of the locking ring in the corner regions thereof. The intermediate piece may be fastened in the locking ring by means of transverse pins. The transverse pins are arranged in the support webs. The locking ring-intermediate piece receiving means may be embodied as a unitary component, preferably as a pressure cast or die cast formed part. The intermediate piece may be arranged positively insertable in the locking ring by means of an outer multiple-sided portion. The outer multiple-sided portion of the intermediate piece may have a peripheral groove which receives a spring ring of the locking ring. The intermediate piece may have two four-sided holes of different sizes, and these holes are provided on both end faces of the intermediate piece. By application of the foregoing features, satisfactory arrangement of the intermediate piece in the locking ring is obtained with high positive force in an advantageous manner.

Referring now to the drawings in detail, the ratchet lever 1 illustrated in the drawings has an actuating arm 2 with a ratchet head 3 which has a head ring 4 with an arresting portion 5. An abutment wall 6 is arranged on the end face side of the head ring 4 so that in this region the diameter of the bore 7 of the head ring 4 is smaller. The arresting or locking portion 5 has a spring-loaded arresting bolt or stud 8, the free end of which projects into the bore 7 and has an abutment surface 9 as well as a slide incline 10. The arresting bolt 8 is capable of being withdrawn from the region of the bore 7 against the spring force or tension by the handle means 11 and the arresting bolt 8 is rotatable about its longitudinal axis.

According to FIG. 1, a locking ring 12 is inserted in the bore 7 of the head ring 4. This locking ring 12 has an outer toothing 13 that rests against the abutment wall 6 of the head ring 4, and in the tooth gaps 14 of which the arresting bolt 8 engages. The locking or latching ring 12 has an octagonal multiple-sided hole 15 in which an intermediate or connecting piece 16 is arranged. The intermediate piece 16 has a hole 17 with four sides. Into this four-sided hole 17 is inserted the outer four-sided portion 18 of a special radiator nipple key 19, which serves in the assembly of heating body radiators. Support webs or crosspieces 20 are arranged on the intermediate piece 16, and are supported against rotation in the four oppositely located corner regions 21 of the multiple-sided hole 15. Additionally, the intermediate piece 16 is fastened or secured in the locking ring 12 by transverse pins 22, which are arranged in the support webs 20, so that a unitary structural part is formed and a good transfer of force results with no axial and radial displacement.

According to another embodiment, it is also possible to embody the locking-ring intermediate-piece receiving means for the outer four-sided portion 18 of the radiator nipple key 19 as a unitary component or part, preferably as a pressure cast or die cast form or mold part, e.g. out of metal.

Figure 2:
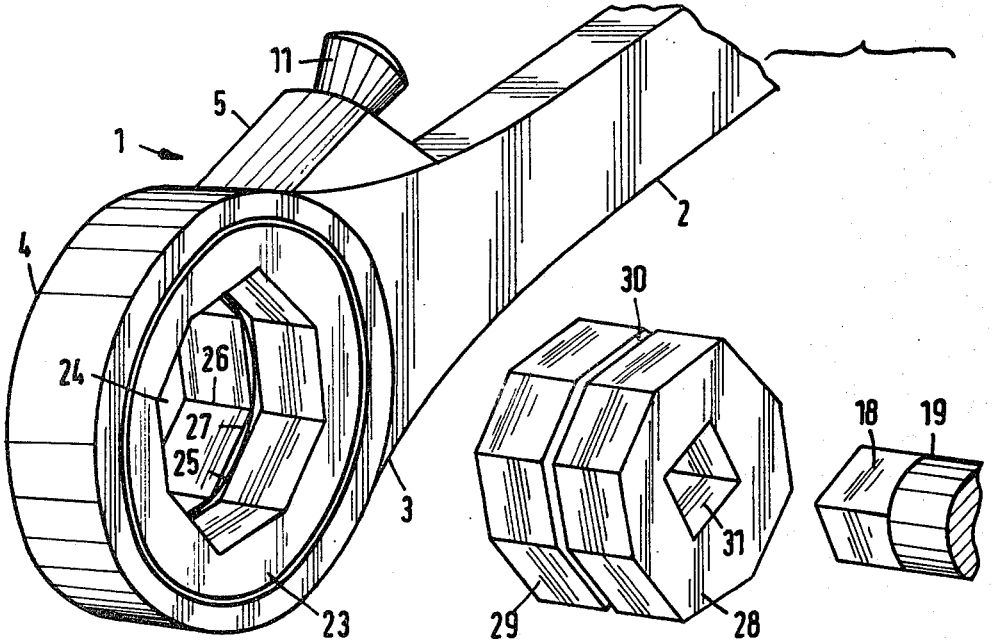
FIG. 2 is a partial exploded view of a ratchet lever according to FIG. 1 having an insertable intermediate piece.

In FIG. 2, a locking ring 23 is inserted in the head ring 4 of the ratchet lever 1. This locking ring 23 has a spring ring (circlip) 25 in the region of the octagonal multiple-sided hole 24. The spring ring 25 is so embodied that, in the corner regions 26 of the multiple-sided hole, it projects from its groove bed 27 somewhat into the multiple-sided hole 24. An intermediate piece 28 is inserted into the multiple-sided hole 24 of the head ring 4. The intermediate piece 28 has an octagonal outer multiple-sided portion 29, so that a positive closed support is provided upon insertion. A peripheral groove 30 is arranged in the outer multiple-sided portion 29 of the intermediate piece 28. The width of the peripheral groove 30 essentially corresponds to the width of the groove bed 27 of the locking ring 23. During insertion of the intermediate piece 28 into the multiple-sided hole 24 of the locking ring 23, the spring ring 25 is pressed into the groove bed or recess 27. When the intermediate piece 28 has reached its end position in the locking ring 23, the spring ring 25 automatically engages in the peripheral groove 30 of the intermediate piece 28 and secures it in the axial direction. The peripheral groove 30 is arranged along the outer multiple-sided portion 29 in such a way that the spring ring 25, upon impact of the ratchet head 3 on a suitable surface, is pressed radially outwardly in the groove bed or recess 27, releasing the intermediate piece 28. The intermediate piece 28 likewise has a square or four-sided hole 31 into which the outer four-sided portion 18 of the radiator nipple key 19 is inserted.

If a pipe thread is to be cut with the aid of the ratchet lever 1, then the locking ring 12 illustrated in the embodiment of FIG. 1, complete with the intermediate piece 16, is removed from the head ring 4 and is replaced with a locking ring 23 according to FIG. 2, into the multiple-sided hole 24 of which the insert extension of the thread-cutting head is then inserted; while with the embodiment according to FIG. 2, the locking ring 23 remains in the head ring 4 and the intermediate piece 28 is selectively exchangeable for the thread-cutting head, so that the installer of a heating unit can, with a single lever tool, not only assemble heating body radiators, but can also cut pipe threads for heating pipes.

Figure 3:
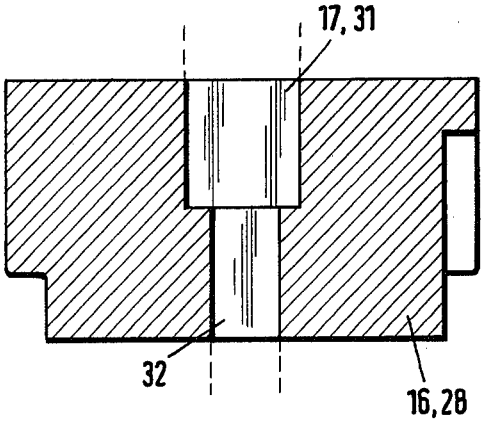
FIG. 3 is an axial cross section of a second embodiment of an intermediate piece of a ratchet lever in accordance with the present invention.

As shown in FIG. 3, the intermediate piece 16 and/or the intermediate piece 28 can have a further four-sided hole 32, which has a different size and which is located on that end face opposite the four-sided hole 17, so that different radiator nipple keys 19 can be used. The four-sided holes 17, 31 or 32 of each intermediate piece 16, 28 advantageously have a size of 18 mm or 14 mm respectively.

The present invention is, of course, in no way restricted to the specific disclosure of the specification and drawings, but also encompasses any modifications within the scope of the appended claims.

What I claim is:

1. A ratchet lever which comprises:
   an actuating arm;
   a ratchet head arranged on said actuating arm, said ratchet head being provided with a head ring;
   a locking ring interchangeably receivable by said head ring; and
   an intermediate piece arrangeable in said locking ring, said intermediate piece being provided with at least one four-sided hole for insertion connection with a working tool,
   said locking ring being provided with a multiple-sided hole having corner regions, and in which said intermediate piece is provided with support webs arrangeable in said corner regions.

2. A ratchet lever according to claim 1, in which said working tool is a radiator nipple key.

3. A ratchet lever according to claim 1, in which said locking ring includes transverse pins for fastening said intermediate piece therein.

4. A ratchet lever according to claim 3, in which said transverse pins are adapted to engage said support webs.

5. A ratchet lever according to claim 4, in which said locking ring and said intermediate piece are a unitary piece.

6. A ratchet lever according to claim 5, in which said unitary piece is a pressure cast piece.

7. A ratchet lever according to claim 1, in which said locking ring is provided with a multiple-sided hole, and in which said intermediate piece is provided with a corresponding outer multiple-sided portion for positive arrangement in said locking ring.

8. A ratchet lever according to claim 1, in which a spring ring is provided in said hole of said locking ring, and in which said outer multiple-sided portion of said intermediate piece is provided with a peripheral groove for receiving said spring ring.

9. A ratchet lever according to claim 1, in which said intermediate piece has two axially oppositely located end faces and two four-sided holes respectively located in said end faces and having different sizes.

* * * * *